US011535507B2

(12) United States Patent
Margulis

(10) Patent No.: US 11,535,507 B2
(45) Date of Patent: Dec. 27, 2022

(54) FUEL ADDITIVE BOTTLES COMPATIBLE WITH CAPLESS FUEL SYSTEMS

(71) Applicant: 3 Ring Packaging, LLC, Boca Raton, FL (US)

(72) Inventor: Barry J. Margulis, Manasquan, NJ (US)

(73) Assignee: 3 Ring Packaging, LLC, Boca Raton, FL (US)

( * ) Notice: Subject to any disclaimer, the term of this patent is extended or adjusted under 35 U.S.C. 154(b) by 323 days.

(21) Appl. No.: 15/661,385

(22) Filed: Jul. 27, 2017

(65) Prior Publication Data

US 2018/0029874 A1 Feb. 1, 2018

Related U.S. Application Data

(60) Provisional application No. 62/369,509, filed on Aug. 1, 2016.

(51) Int. Cl.

| | |
|---|---|
| ***B67D 7/42*** | (2010.01) |
| ***B67D 7/02*** | (2010.01) |
| ***B65D 1/02*** | (2006.01) |

(52) U.S. Cl.

CPC ..... *B67D 7/42* (2013.01); *B65D 1/023* (2013.01); *B65D 1/0207* (2013.01); *B65D 1/0246* (2013.01); *B67D 7/0288* (2013.01); *B65D 2205/00* (2013.01)

(58) Field of Classification Search

CPC ..... B67D 7/42; B67D 7/0288; B65D 1/0207; B65D 1/023; B65D 1/0246; B65D 2205/00

USPC ..... 141/299, 300, 331

See application file for complete search history.

(56) References Cited

U.S. PATENT DOCUMENTS

| | | | | | |
|---|---|---|---|---|---|
| 135,391 | A * | 1/1873 | Way | B67C 11/02 | 141/310 |
| 299,170 | A * | 5/1884 | Shafer | B67C 11/02 | 141/297 |
| 357,476 | A * | 2/1887 | Gersdorff | B67C 11/02 | 141/297 |
| 517,800 | A * | 4/1894 | Friedman | B65D 1/023 | 215/42 |
| 978,736 | A * | 12/1910 | Graham | 215/383 | |
| 1,487,824 | A * | 3/1924 | Vincent | B67C 11/02 | 141/297 |
| 1,522,167 | A * | 1/1925 | Young | B67C 11/02 | 141/331 |
| 1,523,696 | A * | 1/1925 | Lewis | F16N 3/04 | 141/309 |
| 1,589,500 | A * | 6/1926 | Wilcox | B60K 15/04 | 220/86.2 |
| 1,612,383 | A * | 12/1926 | Lepeshkin | B67C 11/02 | 141/300 |

(Continued)

FOREIGN PATENT DOCUMENTS

DE 6935724 U * 1/1970

*Primary Examiner* — Timothy L Maust

(74) *Attorney, Agent, or Firm* — Bachman & LaPointe, P.C.

(57) ABSTRACT

A bottle body comprises: a main body extending from a base to a shoulder; a neck extending from the shoulder to a mouth a thread along the neck; and one or more recesses along an exterior of the neck and extending along a longitudinal span of at least 30 mm.

20 Claims, 5 Drawing Sheets

(56) References Cited

U.S. PATENT DOCUMENTS 2,169,686 A * 8/1939 Fabrice ..... B65D 41/3404 215/254
2,263,221 A * 11/1941 Merrill ..... F16L 35/005 361/215
2,898,014 A * 8/1959 Borah ..... B65D 47/063 222/481.5
3,063,451 A * 11/1962 Kowalk ..... A61M 5/162 600/576
3,330,312 A * 7/1967 Parady ..... H01M 2/362 137/453
3,347,420 A * 10/1967 Donoghue ..... G01F 11/286 222/129
3,369,695 A * 2/1968 Johnson ..... B60K 15/04 141/300
D214,549 S * 7/1969 Ledewitz ..... D9/741
3,537,623 A * 11/1970 Fisher ..... B65D 47/122 222/460
3,729,031 A * 4/1973 Baldwin ..... A61M 5/1782 141/2
4,007,848 A * 2/1977 Snyder ..... B65D 41/348 215/307
4,058,121 A * 11/1977 Choksi ..... A61J 1/2096 604/411
4,597,513 A * 7/1986 Schiemann ..... B65D 47/06 222/478
4,649,068 A * 3/1987 Collette ..... B29C 45/26 215/42
4,886,194 A * 12/1989 Schiemann ..... B65D 25/48 222/478
5,133,481 A * 7/1992 Mayfield ..... B65D 25/44 141/299
5,220,949 A * 6/1993 Rufenacht ..... B67C 9/00 141/285
5,246,126 A * 9/1993 Lewis, Jr. ..... B65D 1/0253 215/232
5,277,234 A * 1/1994 Warstler ..... B67C 11/04 141/297
5,290,257 A * 3/1994 Zhong ..... A61M 1/84 604/316
5,366,774 A * 11/1994 Pinto ..... B29C 49/0078 215/42
D375,878 S * 11/1996 Morris ..... D7/700
5,634,504 A * 6/1997 Chandler ..... B65D 51/1611 141/114
D386,679 S * 11/1997 Beaver ..... D9/558
5,722,570 A * 3/1998 Sultzer, III ..... B65D 47/063 222/529
6,006,930 A * 12/1999 Dreyer ..... B65D 51/1688 215/44
D419,077 S * 1/2000 Sultan ..... D9/563
D422,919 S * 4/2000 Scriven ..... D9/523
D430,798 S * 9/2000 Stevens ..... D9/520
6,123,212 A * 9/2000 Russell ..... B65D 41/0471 215/307
6,142,193 A * 11/2000 Sanders ..... B65B 39/04 141/300
6,318,422 B2 * 11/2001 Woratyla ..... B67C 11/02 141/331
D508,855 S * 8/2005 Hasler ..... D9/523
D544,353 S * 6/2007 Dodd ..... D9/516
D555,481 S * 11/2007 Tseng ..... D9/523
D576,884 S * 9/2008 Feen ..... D9/523
8,251,110 B2 * 8/2012 Bassett ..... A47K 5/12 141/319
D729,630 S * 5/2015 Serrano ..... D9/453
9,216,138 B2 * 12/2015 Finke ..... A61J 1/2089
D818,829 S * 5/2018 Dumortier ..... D9/523
2002/0056488 A1 * 5/2002 Hughes ..... B65D 25/48 141/392
2005/0133533 A1 * 6/2005 Wichmann ..... B65D 81/3283 222/145.5
2006/0266431 A1 * 11/2006 Thilly ..... A61M 5/162 141/329
2007/0119517 A1 * 5/2007 Grace ..... B65D 1/06 141/319
2008/0230505 A1 * 9/2008 Kerman ..... B65D 41/0471 215/44
2015/0013822 A1 1/2015 Baker
2015/0298384 A1 10/2015 McKenzie et al.
2016/0031697 A1 2/2016 Zweifel
2016/0122066 A1 * 5/2016 DiBiasio ..... B29C 49/4802 264/515

* cited by examiner

FUEL ADDITIVE BOTTLES COMPATIBLE WITH CAPLESS FUEL SYSTEMS

CROSS-REFERENCE TO RELATED APPLICATION

Benefit is claimed of U.S. Patent Application No. 62/369,509, filed Aug. 1, 2016, and entitled "Fuel Additive Bottles Compatible with Capless Fuel Systems", the disclosure of which is incorporated by reference herein in its entirety as if set forth at length.

BACKGROUND

The disclosure relates to fuel additive bottles. More particularly, the disclosure relates to bottles compatible with capless fuel systems.

Fuel additive bottles for use with capless fuel systems are show in: United States Patent Application Publication 20160031697 A1, of Zweifel, published Feb. 4, 2016 and entitled "CATCH RELEASING CAPLESS FUEL-FILLER BOTTLE; United States Patent Application Publication 20150298384 A1, of McKenzie et al., published Oct. 22, 2015 and entitled "FUEL ADDITIVE BOTTLE FOR COMPATIBILITY WITH CAPLESS FUEL TANK; and United States Patent Application Publication 20150013822 A1, of Baker, published Jan. 15, 2015 and entitled "FUEL ADDITIVE BOTTLE FOR USE WITH CAPLESS FUEL SYSTEM". The disclosures of these publications ae incorporated by reference in their entireties herein as if set forth at length.

The three publications identified above all disclose different molded plastic bottles having threaded mouths. McKenzie et al. has an internally-threaded mouth. This avoids catching of threads on internal flaps or other elements of the capless filler.

The Baker publication and the Zweifel publication each disclose thread interruptions. The Baker publication involves an interruption as a local flat reducing the height of the thread. The Zweifel publication involves a recess fully penetrating the thread.

SUMMARY

One aspect of the disclosure involves a bottle body comprising: a main body extending from a base to a shoulder; a neck extending from the shoulder to a mouth a thread along the neck; and one or more recesses along an exterior of the neck and extending along a longitudinal span of at least 30 mm.

In one or more embodiments of any of the foregoing embodiments, the thread is an external thread.

In one or more embodiments of any of the foregoing embodiments, the external thread is flush or subflush to a portion of the neck through which the at least one recess passes.

In one or more embodiments of any of the foregoing embodiments, the one or more recesses extend through the thread.

In one or more embodiments of any of the foregoing embodiments, the one or more recesses extend along an unthreaded portion of the neck below the thread.

In one or more embodiments of any of the foregoing embodiments, the one or more recesses extend along a tapering portion of said unthreaded portion and a straight portion of said unthreaded portion between the tapering portion and the thread.

In one or more embodiments of any of the foregoing embodiments, the one or more recesses comprise four recesses at 90° intervals about the neck.

In one or more embodiments of any of the foregoing embodiments, the one or more recesses have depth of at least 1.0 mm.

In one or more embodiments of any of the foregoing embodiments, the one or more recesses have depth of at least 1.0 mm.

In one or more embodiments of any of the foregoing embodiments, the longitudinal span is at least 40 mm.

In one or more embodiments of any of the foregoing embodiments, the bottle body is formed of molded plastic.

In one or more embodiments of any of the foregoing embodiments, a bottle comprises the bottle body and further comprises a cap having a cap thread threaded to the bottle body thread.

In one or more embodiments of any of the foregoing embodiments, the bottle further comprises fuel additive contained in the bottle body.

In one or more embodiments of any of the foregoing embodiments, a method for using the bottle comprises: removing the cap; inserting the neck of the bottle body into a filler of a vehicle; and dispensing fuel additive from the bottle body into the filler.

In one or more embodiments of any of the foregoing embodiments, during the dispensing, vapor vents through the at least one recess.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
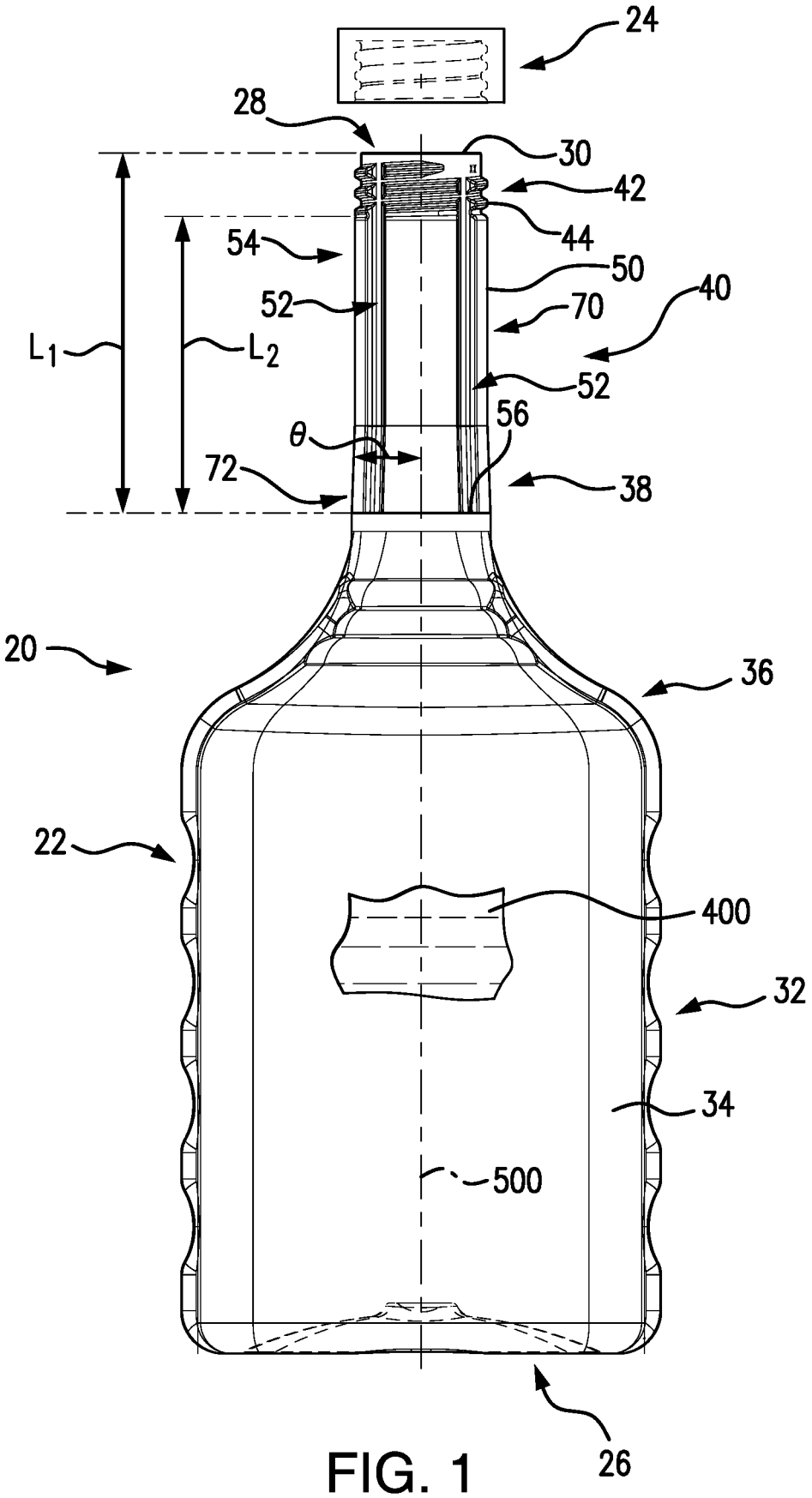
FIG. 1 is a front view of a bottle with a cap exploded away from the bottle body and bottle body partially cut away to show fuel additive contained therein.
Figure 2:
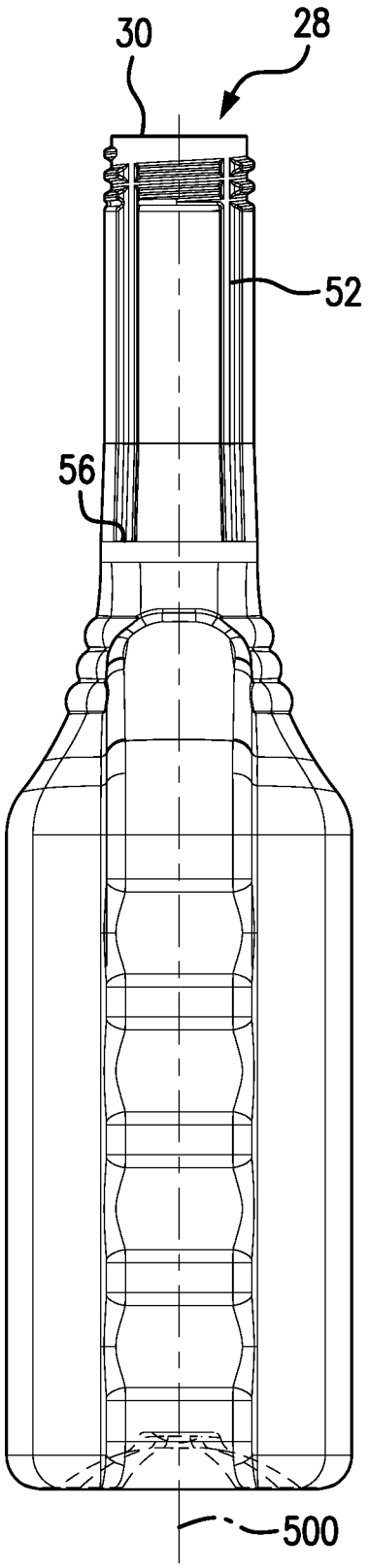
FIG. 2 is a side view of the bottle body.

FIG. 1 shows a bottle 20 having a body 22 (e.g., injection blow molded) and a cap or closure 24 (e.g., injection molded). As is discussed further below, the bottle may represent a reengineering of one particular baseline. Other baselines include those of the three publications mentioned above and yet further bottles (e.g., including those with pry-off closures rather than threaded closures). The bottle body is shown cut away to show a fuel additive 400 contained therein. The body 22 extends along a central longitudinal axis 500 (vertical in a normal upright storage condition of the bottle) from a base 26 to a mouth 28 at a rim 30. The body has a main body portion 32 having a sidewall portion 34 transitioning at a shoulder 36 to a root 38 of a neck portion (neck) 40. An upper portion 42 of the neck bears an external thread 44 for engaging a complementary internal thread of the closure. The exemplary thread is an industry-standard 22-millimeter finish. The cap may be a child-resistant closure (CRC) (e.g., two-piece (not shown)) or a single-piece (exclusive of liner if any) continuous thread (CT) cap.

Along an external surface 50, the neck bears one or more longitudinal channels (recesses) 52. Exemplary channels 52 extend through the external thread 44 and along an unthreaded portion 54 of the neck, terminating at respective lower ends 56. In the exemplary embodiment, there are four channels 52 at 90° intervals. In the illustrated embodiment, the thread is shown flush to the neck through which the recesses pass. More broadly characterized it is not proud of (i.e., it is flush or subflush to) the neck through which the recesses pass.

FIG. 1 shows the channels extending an overall length $L_1$ from the rim 30 and along a length $L_2$ of the unthreaded portion. Exemplary $L_1$ is at least 40 mm and exemplary $L_2$ is at least 30 mm.

Figure 3:
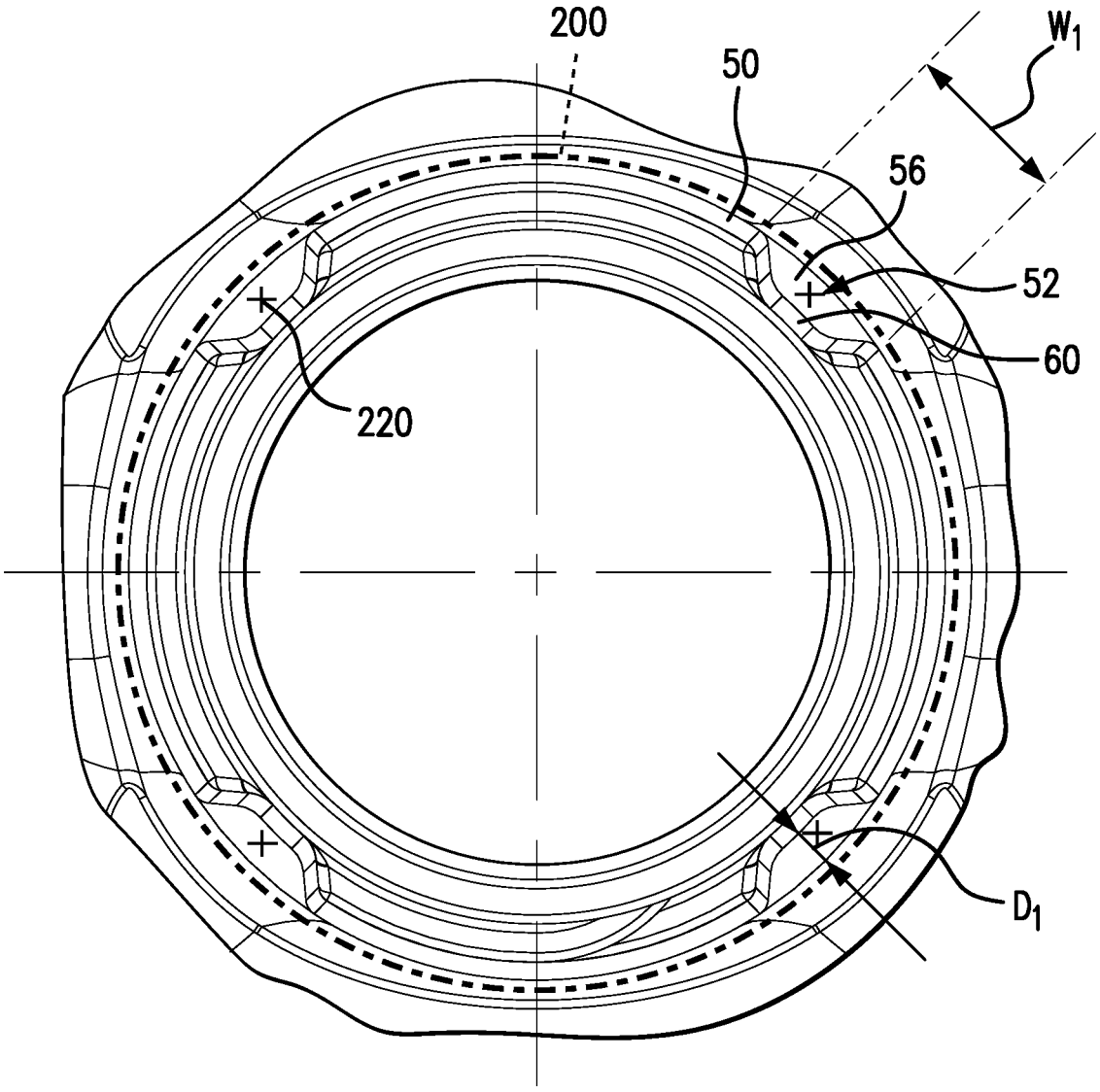
FIG. 3 is a cutaway top view of the bottle body.
Figure 4:
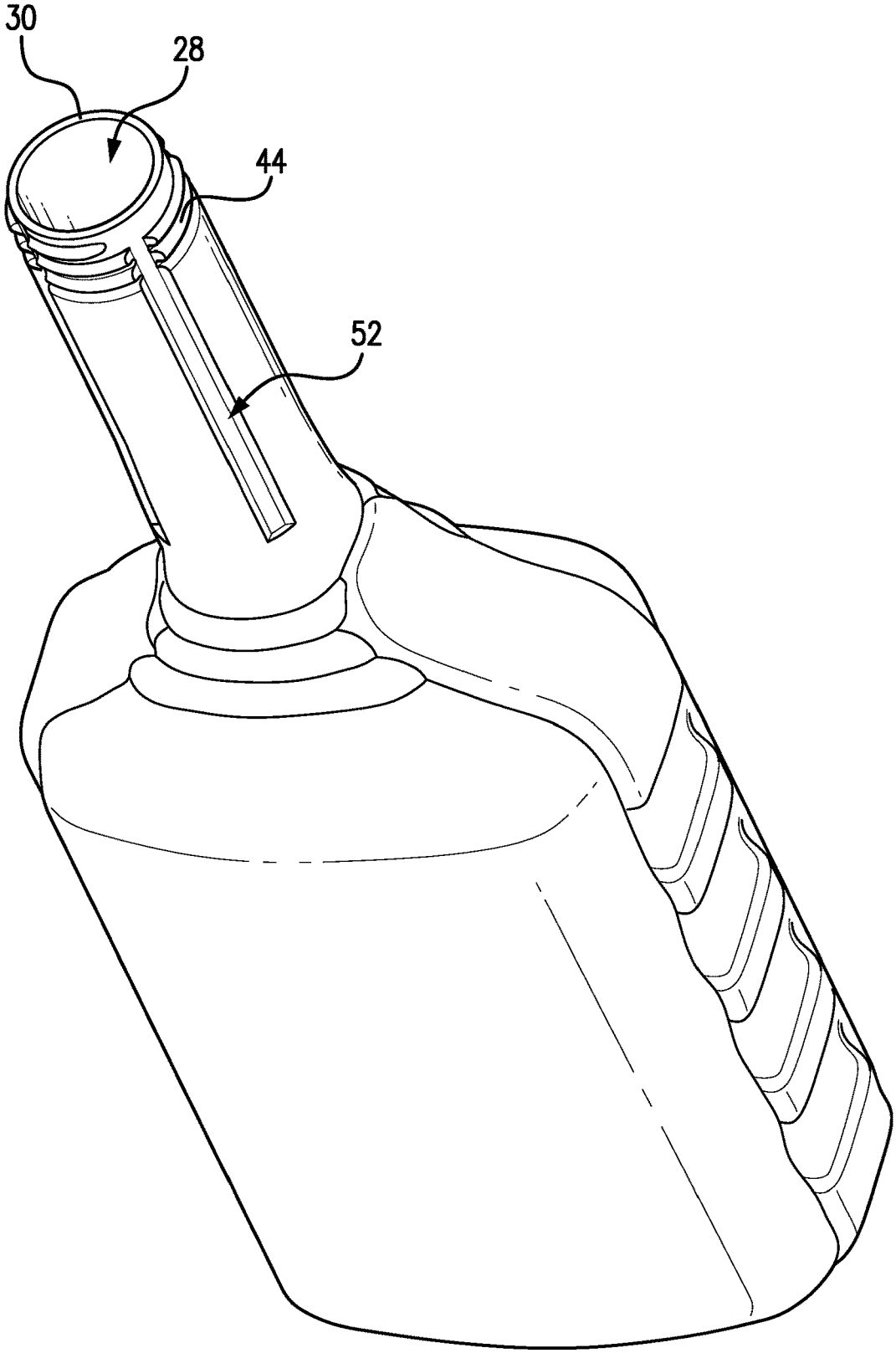
FIG. 4 is a view of the body.

FIG. 3 shows a channel base 60 diametrically recessed from the intact surface by an exemplary channel depth $D_1$ of at least 0.5 mm, more particularly, 0.8-2.0 mm or 0.9-1.5 mm. The exemplary channel width Wi is at least 1.0 mm, more particularly, at least 2.0 mm. In the exemplary embodiment, the channel base is approximately 2.0 mm wide with a channel mouth at the surface 50 being approximately 4.0 mm wide.

Figure 5:
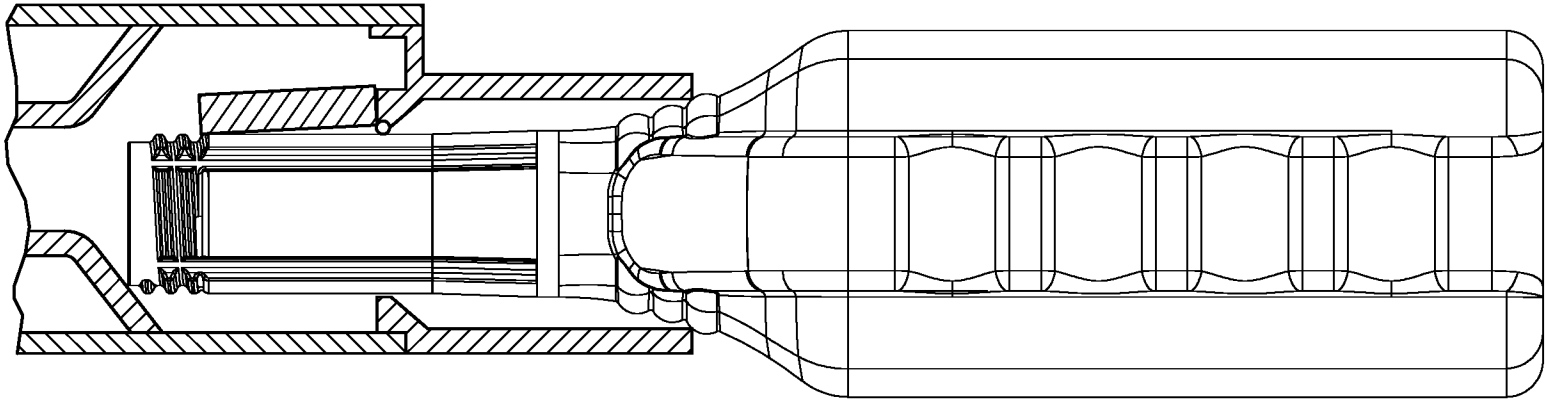
FIG. 5 is a cutaway view of a filler with the bottle body inserted.

Whereas the aforementioned recesses or flats of the Zweifel publication extend slightly onto the unthreaded portion of the neck, they do not extend far enough to reach any restriction in the filler (e.g., at a location of the hinge of the flapper in the single flapper embodiment illustrated and the outer of two flappers in the two-flapper embodiment). With the channels 52 long enough to pass adjacent any chokepoint in the filler, the channels may serve as vents to vent vapor from the tank and, thereby, speed the emptying of the bottle. FIG. 3 schematically shows the filler 200 in broken lines and venting flows 220. FIG. 5 shows the bottle in a Zweifel filler.

Even if there is nominal clearance between the outer diameter surface of an ungrooved neck and the inner diameter surface of the filler, misalignment/deformation of the neck (i.e., the bottle axis 500 is rotated off parallel to the filler axis) may contribute to airflow blockage and thus hinder bottle emptying. By providing the channels 52, emptying is facilitated despite misalignments.

In the exemplary embodiment, the channels 52 extend along a straight essentially untapering upper portion 70 (FIG. 1) of the unthreaded portion 50 and a downwardly divergent portion 72 therebelow. This divergent portion 72 has a small half angle θ (e.g., about 2°). In the context of a standard size capless filler, the exemplary diameter at the unthreaded portion upper portion 70 is 21.69 mm, transitioning to 22.69 mm at the base of the divergent portion at the groove lower ends 56. A more broad example of diameter is 20.0 mm to 25.0 mm along these portions, with an exemplary 21.0 mm to 22.5 mm (or 21.50 mm to 22.0 mm) along the portion 70 and really no upper limit on the portion 72.

The bottle may be made using otherwise conventional or yet-developed materials and techniques. Exemplary materials are plastics such as polyethylene (e.g., HDPE) or polyethylene terephthalate (PET). An exemplary technique is injection blow molding.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A fuel additive bottle body comprising:
a main body extending from a base to a shoulder;
a neck extending from the shoulder to a mouth;
an external thread along the neck; and
one or more recesses along an exterior of the neck and extending along a longitudinal span of at least 40 mm, wherein: the one or more recesses extend along an unthreaded portion of the neck below the thread for a length of the unthreaded portion of at least 30 mm; the one or more recesses have a width of at least 1.0 mm and a depth of at least 0.5 mm; and a diameter of an upper portion of the unthreaded portion is 21.0 mm to 22.5 mm.

2. The bottle body of claim 1 wherein:
the one or more recesses have said width of 2.0 mm to 4.0 mm.

3. The bottle body of claim 2 wherein:
the external thread is flush or subflush to a portion of the neck through which the at least one recess passes.

4. The bottle body of claim 1 wherein:
the one or more recesses extend through the thread.

5. The bottle body of claim 4 wherein:
the one or more recesses have said width of 2.0 mm to 4.0 mm and said depth of at least 1.0 mm.

6. The bottle body of claim 5 wherein said upper portion is a straight portion; and:
the one or more recesses extend along a tapering portion of said unthreaded portion and said straight portion of said unthreaded portion between the tapering portion and the thread.

7. The bottle body of claim 1 wherein:
the one or more recesses comprise four recesses at 90° intervals about the neck.

8. The bottle body of claim 7 wherein:
the one or more recesses are channels having a base and a mouth and said depth of at least 1.0 mm.

9. The bottle body of claim 1 wherein:
the one or more recesses are channels having a base and a mouth and said depth of at least 1.0 mm.

10. The bottle body of claim 1 wherein:
and the one or more recesses extend along;
a lower portion of the unthreaded portion divergent relative to the upper portion.

11. The bottle body of claim 10 wherein:
the one or more recesses have a width of 2.0 mm to 4.0 mm and depth of at least 1.0 mm; and
the bottle body is formed of molded plastic.

12. A bottle comprising the bottle body of claim 1 and further comprising:
a cap having a cap thread threaded to the bottle body thread.

13. The bottle of claim 12 further comprising:
fuel additive contained in the bottle body.

14. A method for using the bottle of claim 13, the method comprising:
removing the cap;

inserting the neck of the bottle body into a filler of a vehicle; and dispensing fuel additive from the bottle body into the filler.

15. The method of claim 14 further comprising:

venting vapor through the at least one recess.

16. The method of claim 15, wherein:

the inserting opens a flapper of the filler; and the venting is during the dispensing.

17. The method of claim 16, wherein:

the external thread is not proud of the neck through which the at least one recess passes.

18. The method of claim 17, wherein:

the one or more recesses extend through the thread.

19. The method of claim 18, wherein: said upper portion is a straight portion; and the one or more recesses extend along a tapering portion of said unthreaded portion and said straight portion of said unthreaded portion between the tapering portion and the thread.

20. The bottle body of claim 4 wherein:

the external thread is not proud of the neck through which the at least one recess passes.

* * * * *